US006533069B1

(12) United States Patent
Couillard

(10) Patent No.: US 6,533,069 B1
(45) Date of Patent: Mar. 18, 2003

(54) MULTI-USE LADDER SUPPORT APPARATUS

(76) Inventor: Richard Couillard, 3612 Mariner La., Fort Collins, CO (US) 80525

( * ) Notice: Subject to any disclaimer, the term of this patent is extended or adjusted under 35 U.S.C. 154(b) by 0 days.

(21) Appl. No.: 09/705,196

(22) Filed: Nov. 3, 2000

(51) Int. Cl.[7] ..... E04F 10/00
(52) U.S. Cl. ..... 182/83; 182/107; 182/214
(58) Field of Search ..... 182/83, 106, 107, 182/115, 129, 214, 206; 248/238

(56) References Cited

U.S. PATENT DOCUMENTS

| | | | | | |
|---|---|---|---|---|---|
| 1,517,585 | A | * | 12/1924 | Richardson | 182/83 |
| 2,957,541 | A | * | 10/1960 | Everest et al. | 182/115 |
| 4,061,202 | A | * | 12/1977 | Campbell | 182/214 |
| 4,143,743 | A | | 3/1979 | Larson | 182/206 |
| 4,253,547 | A | | 3/1981 | Skaalen et al. | 182/115 |
| 4,483,416 | A | | 11/1984 | Garcia | 182/107 |
| 4,546,855 | A | | 10/1985 | Lyons | 182/106 |
| 4,643,275 | A | | 2/1987 | LeBlanc | 182/107 |
| 4,664,224 | A | * | 5/1987 | Chen | 182/106 |
| 4,723,632 | A | | 2/1988 | Gedgoudas et al. | 182/214 |
| 4,765,439 | A | | 8/1988 | Kresmery | 182/107 |
| 4,823,912 | A | | 4/1989 | Gould et al. | 182/214 |
| 4,828,073 | A | * | 5/1989 | Friday | 182/36 |
| 4,848,517 | A | * | 7/1989 | Broyles, III | 182/83 |
| 4,909,351 | A | * | 3/1990 | Johnson et al. | 182/121 |
| 4,949,810 | A | | 8/1990 | Dwinnell | 182/214 |
| 5,113,973 | A | | 5/1992 | Southern | 182/214 |
| 5,120,013 | A | * | 6/1992 | Sweeney | 248/238 |
| 5,165,501 | A | | 11/1992 | Donahey | 182/214 |
| 5,255,758 | A | * | 10/1993 | Hood, Jr. | 182/179 |
| 5,279,389 | A | | 1/1994 | Crockett | 182/129 |
| 5,383,533 | A | * | 1/1995 | Nikula et al. | 182/214 X |
| 5,460,241 | A | | 10/1995 | LaBelle | 182/214 |
| 5,664,643 | A | * | 9/1997 | Taylor, Jr. | 182/214 |
| 5,743,356 | A | | 4/1998 | Mitchell | 182/214 |
| 5,775,465 | A | | 7/1998 | Vossier | 182/214 |
| 5,855,252 | A | | 1/1999 | Vrolyks | 182/214 |
| 5,941,343 | A | | 8/1999 | Kelsey | 182/107 |
| 6,012,546 | A | | 1/2000 | Bee et al. | 182/107 |
| 6,029,774 | A | | 2/2000 | Cothern | 182/107 |
| 6,029,776 | A | | 2/2000 | Brown | 182/129 |
| 6,158,551 | A | * | 12/2000 | Gray | 182/107 |
| 6,244,383 | B1 | * | 6/2001 | Jung | 182/107 X |
| 6,286,624 | B1 | * | 9/2001 | Bowles | 182/117 |

FOREIGN PATENT DOCUMENTS

| | | | |
|---|---|---|---|
| AU | 217052 | 11/1956 | |
| GB | 2145144 | * 8/1983 | 182/83 |
| GB | 2118236 A | 10/1983 | |
| GB | 2161528 A | 1/1986 | |

* cited by examiner

*Primary Examiner*—Bruce A. Lev
(74) *Attorney, Agent, or Firm*—Sheridan Ross P.C.

(57) ABSTRACT

A multi-use support apparatus mounts a ladder to a support structure. The support apparatus can be configured for use with different support structures, such as parapet walls, flat roofs, sloping roofs and vertical beams or purlins. The support apparatus has a frame and a platform mounted on and supported by the frame. A pair of spaced ladder support brackets mounted on the frame support the upper end of the ladder therebetween.

38 Claims, 4 Drawing Sheets

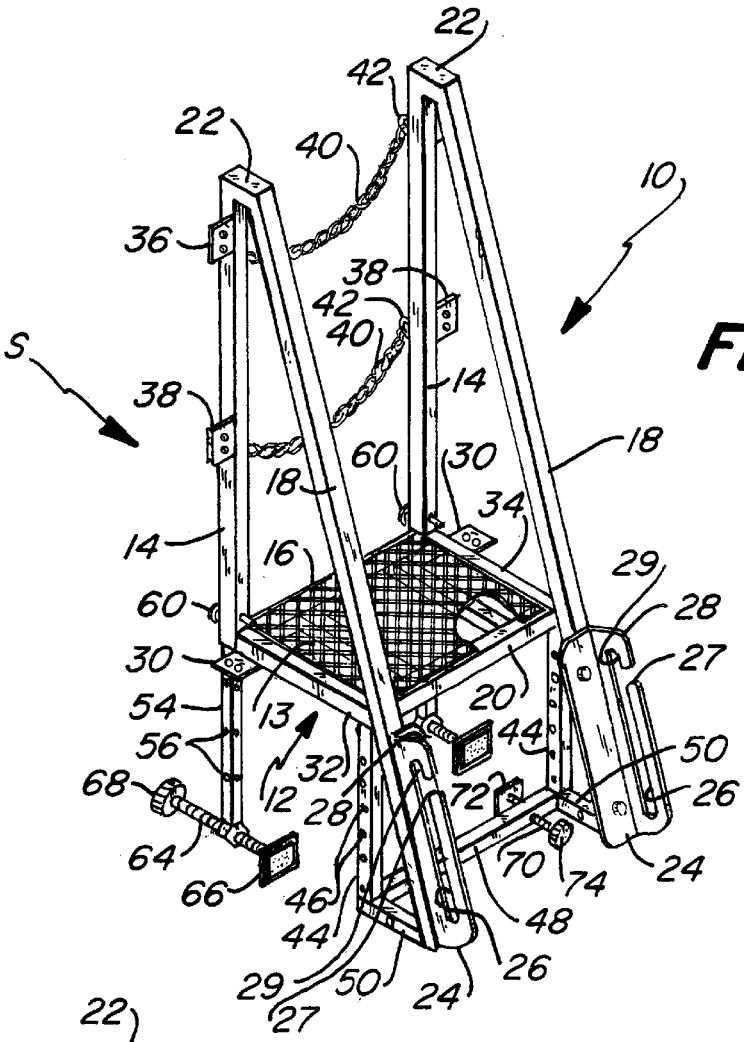
Fig_1
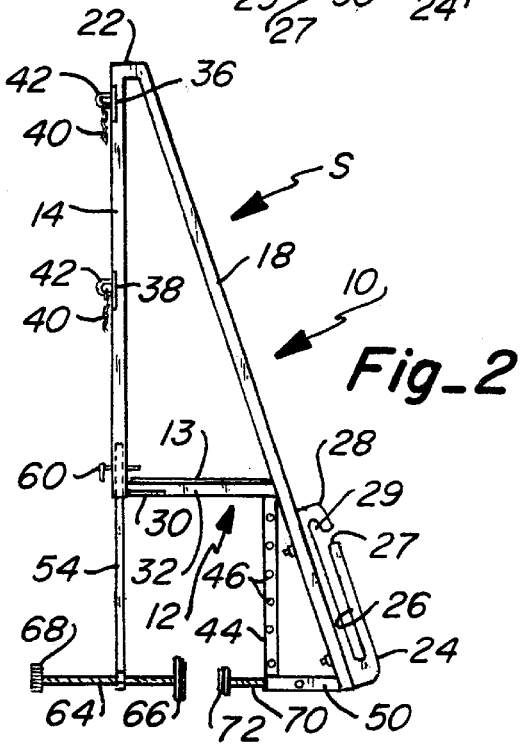
Fig_2
Fig_3
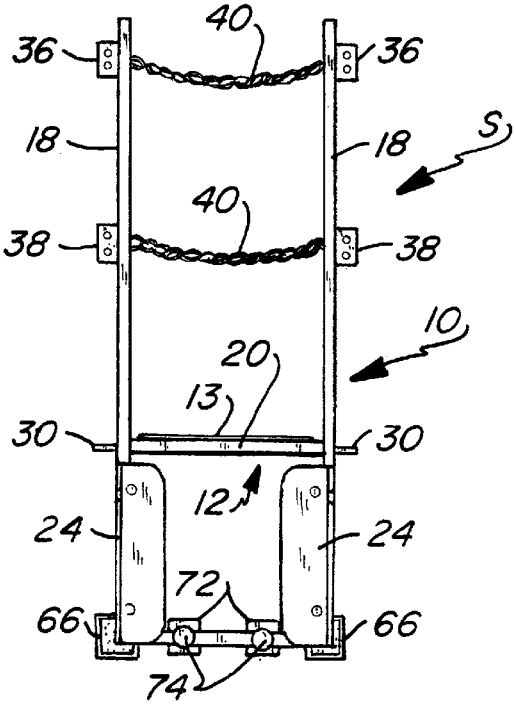

MULTI-USE LADDER SUPPORT APPARATUS

TECHNICAL FIELD

This invention relates to support for the upper end of a ladder when the ladder is in use. More particularly, the invention is directed to a ladder support which is adaptable for use on different support surfaces.

BACKGROUND ART

A universal problem encountered when using a ladder is holding it in a stable position so that the upper end thereof does not slide to one side or the other when a person is climbing up or down on the ladder. Failure to properly secure the upper end of a ladder often results in serious injury to a person on the ladder if it slips sideways. Various attachments for securing the upper end of a ladder to different support services have been devised.

U.S. Pat. No. 4,765,439 to Kresmery and U.S. Pat. No. 5,279,389 to Crockett each disclose a mechanism for attaching the upper end of a ladder to a parapet wall.

U.S. Pat. No. 4,253,547 to Skaalen et al and U.S. Pat. No. 5,941,343 to Kelsey each disclose a mechanism for attaching the upper end of a ladder to the edge of a flat roof.

Patents which disclose devices for attaching or supporting the upper end of a ladder on a sloping roof include U.S. Pat. No. 4,723,632 to Gedgoudas et al; U.S. Pat. No. 4,949,810 to Dwinnell; U.S. Pat. No. 5,165,501 to Donnahey; U.S. Pat. No. 5,743,356 to Mitchell; U.S. Pat. No. 5,775,465 to Vossler; and U.S. Pat. No. 6,012,546 to Bee et al.

While all of these ladder support apparatuses are suitable for their intended purpose, each of them is only usable on one type of support structure. In other words, a support apparatus which is usable on a flat roof may not be used on a sloping roof or a parapet wall. Thus, every time the ladder is to supported on a different type of structure, a different support apparatus is needed.

DISCLOSURE OF THE INVENTION

In accordance with this invention, a multi-use support apparatus is provided for mounting on a support structure for supporting the upper end of a ladder having side rails and hollow tubular rungs. This support apparatus can be arranged in several different configurations for use with different support structures, such as parapet walls, flat roofs, sloping roofs and vertical beams or purlins. The support apparatus has a frame with a platform mounted on and supported thereby. A pair of spaced ladder support brackets mounted on the frame support the end of the ladder therebetween. A ladder attaching device extends through the upper rung of the ladder and is removably connected between the support brackets. The frame includes a pair of vertical rear supports attached to the platform, a pair of angular front supports attached to the platform, the vertical and angular supports both having upper ends extending above the platform and lower ends extending below the platform. Clamping devices are respectively and selectively attached to these lower ends for clamping or connecting to a parapet wall, a flat roof, a sloping roof and/or a vertical support member.

More particularly, the respective upper ends of the angular supports intersect with the upper ends of the respective vertical supports above the platform. The vertical supports have spaced lateral brackets for attachment to the support structure. The ladder support brackets each include a slot extending generally parallel to the annular supports and each having an upper end with an opening. The ladder attachment device includes a movable rod extending between the ladder support brackets and having threaded ends for receiving nuts for locking the rod in place in the slots of the ladder support brackets. The vertical supports and angular supports each have lower ends extending below the platform.

A clamping mechanism includes a first adjustable clamping device mounted adjacent the lower ends of the pair of vertical supports, which include a pair of extension arms slidably received in the lower ends of the respective vertical supports, each extension arm having a lower end with a transverse opening therethrough, a pair of latch devices for holding each respective extension arm in a selected vertical position within the respective vertical supports, and a pair of removable clamps extending through the respective transverse openings and mounted for movement inwardly for clamping engagement with a support structure and moving outwardly for release from the support structure.

The clamping mechanism also includes a second clamping device mounted adjacent the lower ends of the pair of angular supports. A clamp support is attached to the angular support and includes a pair of spaced vertical support struts which extend downwardly from the front of the platform, each having vertically spaced openings extending therethrough. The lower ends of the struts are interconnected by a lateral member. Also, the lower end of each strut is connected by a leg member to the lower end of respective angular supports. A second adjustable clamping device in the form of a pair of spaced clamps extends through spaced openings in the lateral member for movement inwardly for clamping engagement with a support structure and outwardly for release from the support structure.

In another configuration, the extension arms are removed from the vertical supports and inserted into the respective leg members so that the clamps can be moved toward and away from the platform for clamping to the edge of a flat roof.

In still another configuration, a pair of support bars each have a first end pivotally attached to an extension arm through the respective transverse openings and have a second end with a plurality of spaced first openings adjacent the second end thereof and extending therealong for attaching the support bars to a sloping roof. A positioning device is releasably connected through a selected opening in the pair of vertical struts and a selected first opening in the plurality of spaced first openings to position the respective support bars at a selected angle with respect to the vertical struts to correspond to the slope of the roof. Attaching elements extend through the spaced second openings for attaching the respective support bars to the roof.

In an additional configuration, the extension arms are slid upwardly into the lower ends of the respective vertical supports so that only the transverse opening is exposed. A pair of latch devices holds the respective extension arms in this selected vertical position. The transfers openings are arranged so that a first pair of removable clamps extend therethrough for moving inwardly into clamping engagement with a vertical support therebetween and movable outwardly for releasing from clamping engagement with the vertical support. The front end of the frame is supported on the upper rung of a ladder which is locked in a recess at the upper ends of the respective ladder support brackets.

From the foregoing discussion, advantages of this invention are readily apparent. A multi-purpose ladder support has been provided which can be selectively attached to a parapet wall, a flat roof and a sloping roof. Additional advantages of this invention will become apparent from the description which follows, taken in conjunction with the accompanying drawings.

BRIEF DESCRIPTION OF THE DRAWINGS

FIG. 1 is a perspective view of a multi-use ladder support apparatus of this invention.

FIG. 2 is a side view, taken along line 2—2 of FIG. 1;

FIG. 3 is a front elevation of FIG. 1;

BEST MODE FOR CARRYING OUT THE INVENTION

Figure 4:
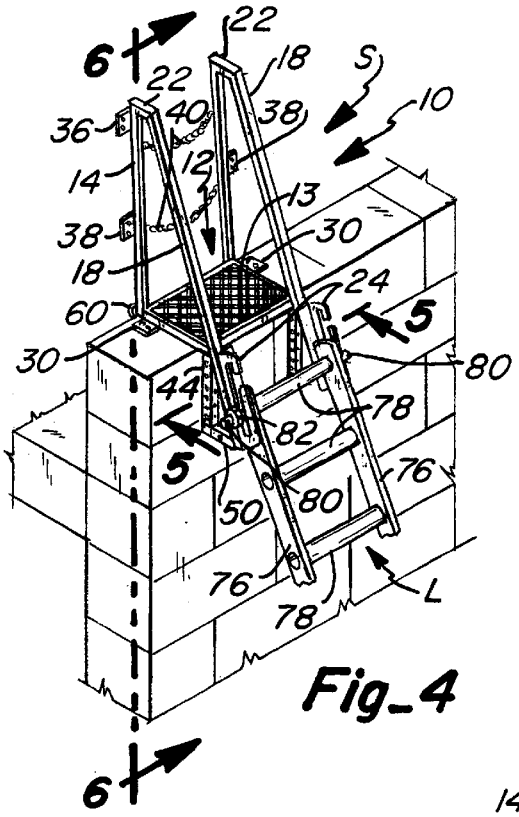
FIG. 4 is a perspective view of the multi-use ladder support apparatus attached to a parapet wall.

The multi-use ladder support apparatus S of this invention includes a frame 10 which supports a platform 12, having an open mesh surface 13 for standing, as shown in FIG. 1. The frame includes a pair of spaced vertical supports 14 attached to and extending upwardly from rear rail 16 forming a rear edge of platform 12. A pair of spaced angular supports 18 are attached to a front rail 20, forming a front edge of platform 12, and have upper ends that extend above platform 12 which are joined to the upper ends of spaced vertical supports 14, as by respective horizontal connecting portions 22. The lower ends of spaced angular supports 18 extend below platform 12 and have ladder attachment devices in the form of respective ladder support brackets 24 attached thereto. The supports and connecting portions are made of tubular steel which is illustrated as having a square cross-section. However, the cross-section could be rectangular or circular. Brackets 24 each include a longitudinal slot 26 which extend generally parallel to angular supports 18 and each has an opening 27 adjacent the upper end thereof and below hook 28. Slot 26 supports a ladder for some configurations of the ladder support apparatus, as explained below. In another configuration, the front of platform 12 is supported by the upper rung of the ladder received in respective recesses 29 formed by hooks 28, also described below.

An attachment bracket 30 extends outwardly from left side rail 32 and right side rail 34 of platform 12, respectively, as shown. Vertical supports 14 each have an upper attachment bracket 36 and a lower attachment bracket 38 extending outwardly, as shown. A pair of vertically spaced safety chains extend between spaced vertical supports 14, there ends being attached to loops 42 secured to the rear surface of vertical supports 14, as by welding. At least one end of each safety chain 40 can be removed from a loop 42 so that a workman can pass between spaced vertical supports 14 onto or off of platform 12.

A pair of spaced vertical support struts 44 extend downwardly from platform side rails 32, 34 adjacent front rail 20 which have vertically spaced openings 46 extending therethrough for a purpose described below. The lower ends of struts 44 are interconnected by a lateral member 48. Additionally, the lower end of each strut 44 is connected to the lower end of each respective angular support 18 by respective legs 50.

Figure 6:
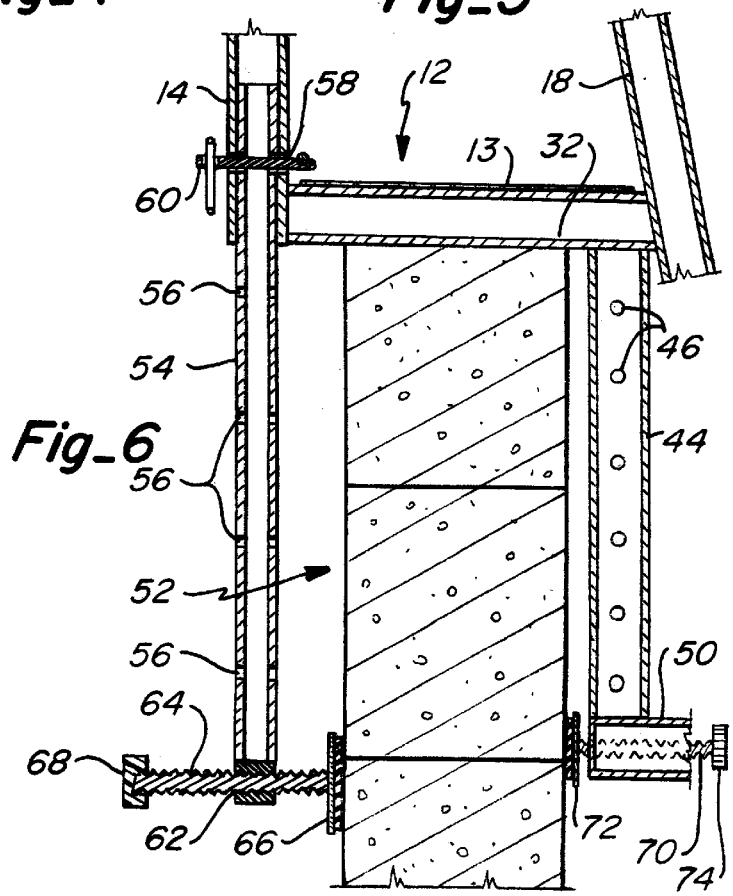
FIG. 6 is an enlarged, fragmentary, vertical section, taken along line 6—6 of FIG. 4 showing details of the clamping mechanisms.

In a first configuration of the multi-purpose ladder support S of this invention, it can be mounted on a parapet wall 52, as best seen in FIGS. 4 and 6. A first adjustable clamping device is mounted at the lower ends of spaced vertical supports 14 and includes a pair of extension arms 54 each of which is sized to be telescopically received in the lower end of a vertical support 14 as best seen in FIGS. 2 and 6. A plurality of vertically spaced adjustment openings 56 extend therethrough and can be selectively aligned with an opening 58 adjacent the lower end of each vertical support 14. A lock pin 60 is extendable through the aligned openings to lock each extension arm in a fixed position. A threaded opening 62 is provided at the lower end of each extension arm 54 for receiving a clamp in the form of a threaded rod 64 which includes a clamp plate 66 on the inner end thereof for engagement with the inner side of parapet wall and a knob 68 on the outer end for rotating rod 64 to move plate 66 toward or away from parapet wall 52. The adjustment openings 56 make it possible to cause clamp plate 66 to engaged the inner surface of parapet wall 52 at one of several selected distances from the top of the wall.

A second adjustable clamping device includes a pair of laterally spaced threaded rods 70 extending through lateral member 48, each rod 70 having an outer clamp plate 72 on the inner end thereof for engagement with the outer surface of parapet wall 52 and a knob 74 on the outer end for rotating rod 70 to move outer clamp plate 72 toward or away from the parapet wall.

Figure 5:
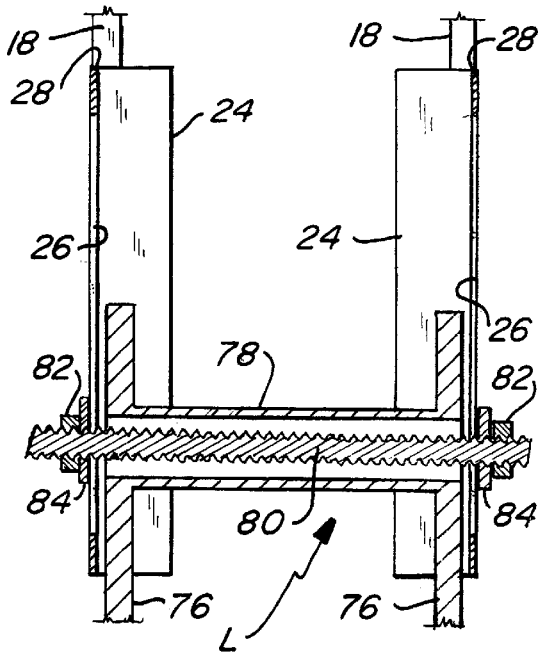
FIG. 5 is an enlarged, fragmentary, vertical section, taken along line 5—5 of FIG. 4 showing the support rod.

A ladder L, as best seen in FIGS. 4 and 5, has side rails 76 interconnected by vertically spaced tubular rungs 78. The brackets 24 on frame 10 are spaced so that the rails 76 of most ladders will fit between them. A ladder attaching device in the form of threaded rod 80 extends through the upper rung 78 of the ladder. A nut 82 a is threaded on each end of rod 80 and one or more spacers, such as spacers 84, can be provided so that the rod can accommodate ladders of slightly different widths. Although rod 80 is shown as being threaded along its entire length, it will be understood that only the ends need be threaded. Once rod 40 has been attached to upper rung 78, the ladder can be easily inserting into or removed from brackets 24. The rod 80 can be inserted through openings 28 in slots 26 of brackets 24 and slid downwardly to attach ladder L to support apparatus S. To remove ladder L from support apparatus S, the ladder is lifted up so that rod 80 moves upwardly in slots 26 and is aligned with and removable through openings 28 to separate ladder L from support apparatus S.

It is also contemplated within the scope of this invention that the spacing of the rails 76 of ladder L can be greater than the spacing of ladder support brackets 24 so that upper rung 78 is received in slots 26 so that no rod 70 is required. With this arrangement, the slots 26 must be sized to receive upper rung 78. While the invention has been described wherein the upper rung is attached to ladder support brackets 24, a selected lower rung could be used where dictated by the job site.

Figure 7:
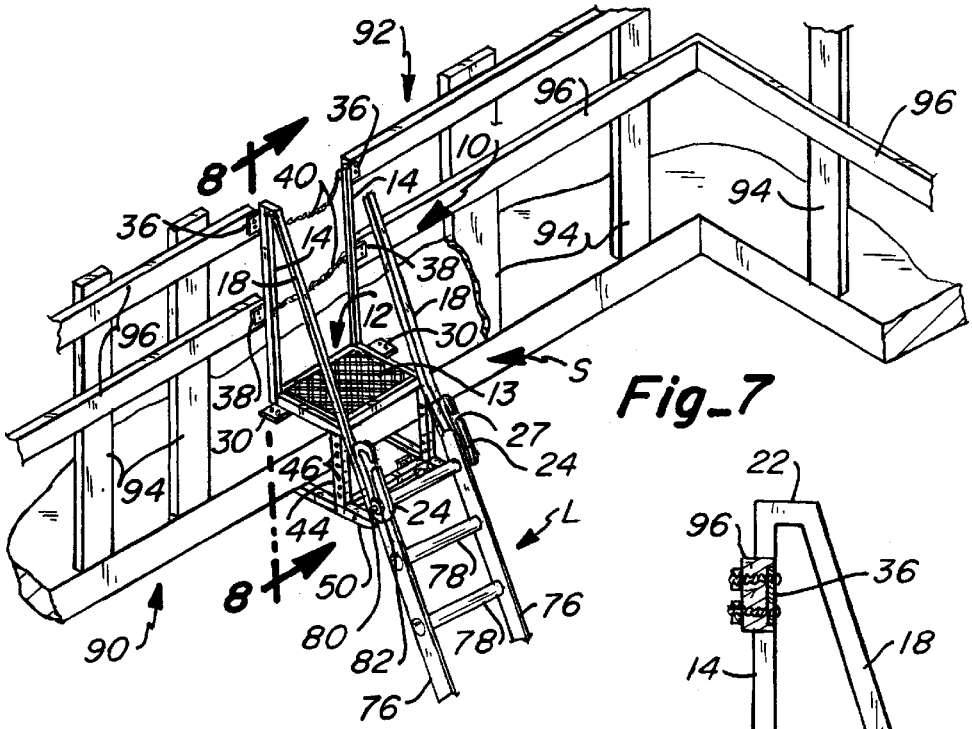
FIG. 7 is a perspective view of the multi-use ladder support apparatus attached to a flat roof.
Figure 8:
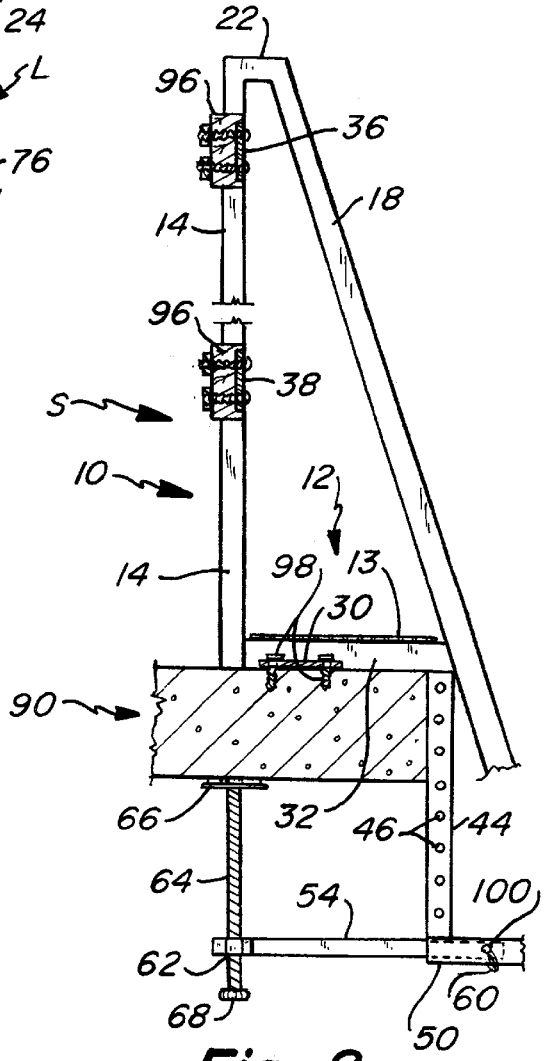
FIG. 8 is an enlarged, fragmentary, horizontal section, taken along line 8—8 of FIG. 7, showing the clamping attachment to the flat roof.

A second configuration of the support apparatus for use with a flat roof 90 is shown in FIGS. 7 and 8 which has a railing 92 extending above it, with spaced vertical posts 94 supporting vertically spaced horizontal rails 96. The ladder support apparatus S is mounted so that mesh surface 13 extends over the edge of roof 90 and is attached thereto by fasteners, such as screws 98, extending through brackets 30, as seen it FIG. 8. Upper and lower brackets 36, 38 of vertical supports 14 are attached in a similar manner to upper and lower rails 96 of railing 92. In order to clamp ladder support S to roof 90, extension arms 54 are removed from vertical supports 14 and inserted into legs 50 and are held in place by latch pin 60 extending through an opening 100 in leg 50. This positions threaded rod 64 in a vertical position so that by turning knob 68 clamp plate 66 can be brought into or out of clamping engagement with the lower surface of roof 90.

Figure 9:
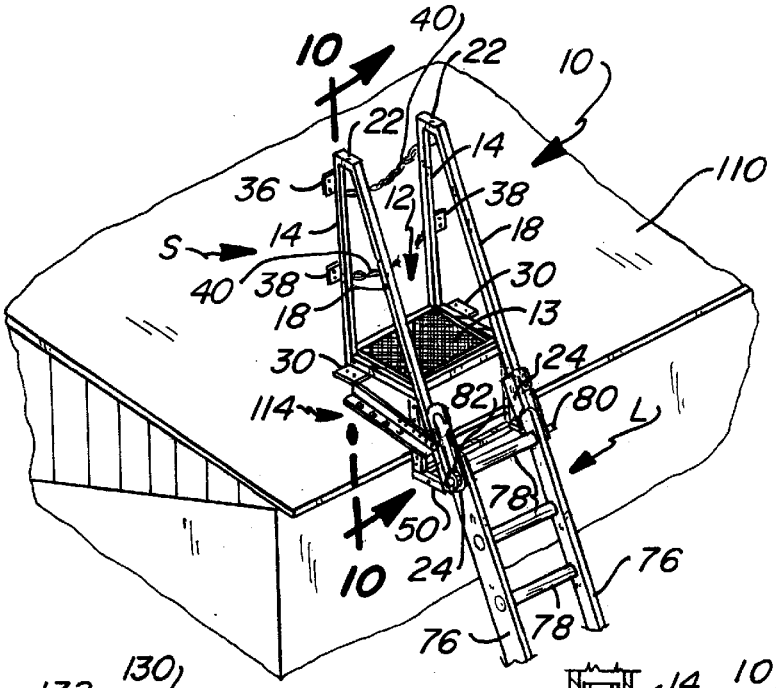
FIG. 9 is a perspective view of the multi-use ladder support apparatus attached to a sloping roof.
Figure 10:
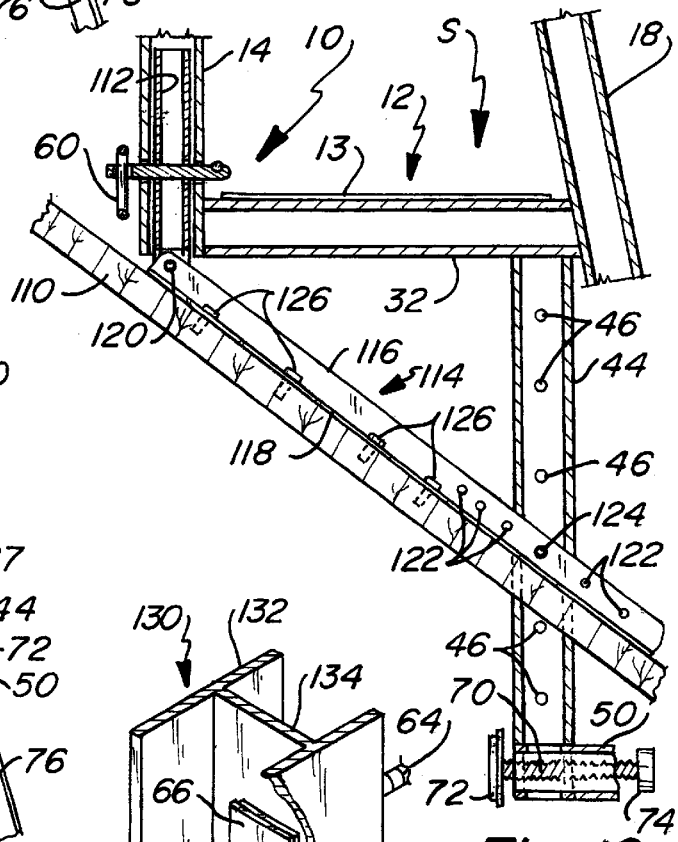
FIG. 10 is an enlarged, fragmentary, vertical section, taken along line 10—10 of FIG. 9 showing the angular adjustment mechanism for accommodating roofs having different slopes.

The ladder support S of this invention also can be used on a sloping roof 110 as shown in FIGS. 9 and 10. For this application, extension arms 54 of FIG. 6 are removed from vertical supports 14 and replaced by a stub shaft 112 whose upper end is inserted in the lower end of vertical support 14 and held in place by latch pin 60. A support bar 114, which is shown in the form of an angle iron having an upwardly extending flange 116 and a laterally extending flange 118, has an upper end pivotally attached to the lower end of stub shaft 112 by a pivot pin 120. A series of longitudinally spaced openings 122 are provided in upwardly extending flange 116 which can be selectively aligned with one of openings 46 in vertical struts 44 so as to conform to the slope of roof 110 and held in position by latch pin 124. The ladder support S is held in place on roof 110 by fastening devices, such as screws 126 which extend through longitudinally spaced openings in lateral flange 118.

Figure 11:
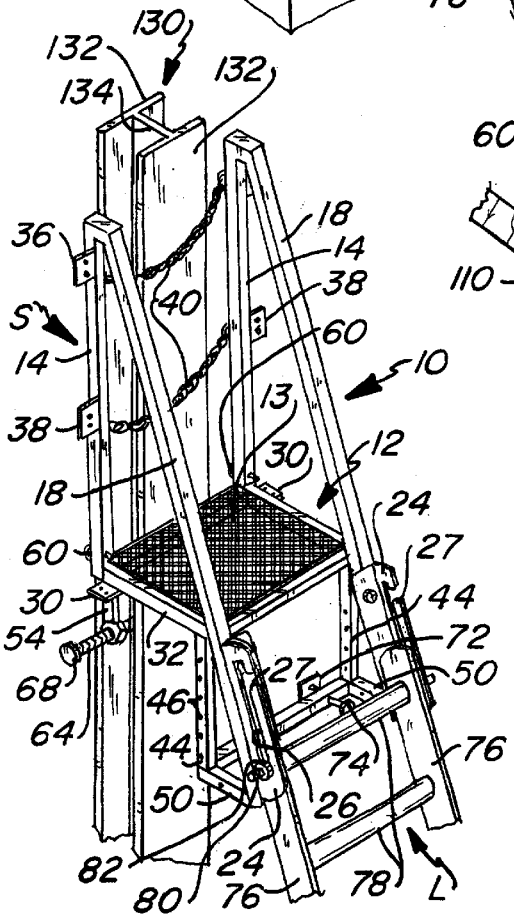
FIG. 11 is a perspective view of the multi-use ladder support apparatus attached to a vertical support.
Figure 12:
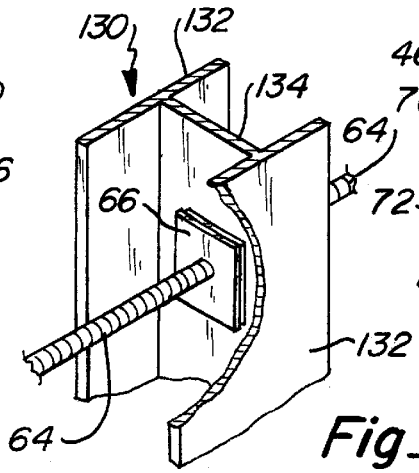
FIG. 12 is an enlarged, fragmentary, perspective view showing the clamping mechanism.

A further configuration of the ladder support S is shown in FIGS. 11 and 12 so that it can be attached to a vertical member, such as I-beam 130 which has flanges 132 interconnected by a web 134. In this configuration, extension arms 54 are removed from vertical supports 14, rotated 90 degrees and reinserted so that threaded rod 64 can be rotated by knob 68 to bring clamp plate 66 into and out of clamping engagement with web 134, as shown. The front of platform 12 is supported by passing the ends of rod 64 through openings 28 and into the respective recesses 29 formed by hooks 28 and placing the foot of the ladder firmly on the ground below in a position to hold rod 64 in recesses 29. If the side rails 76 of ladder L are spaced further apart than ladder support brackets 24, then respective ends of upper rung 78 will be received in recesses 29, which will be sized accordingly.

From the foregoing, the advantages of this invention are readily apparent. A multi-use ladder support apparatus S has been provided which can be configured for use on a parapet wall, a flat roof, a sloping roof and a vertical I-beam type support. Brackets are provided which provide for easy attachment and detachment of the top rung of a ladder to the ladder support by means of a threaded rod extending through the top rung. The ladder support S is of relatively simple construction yet is easily adaptable for supporting a ladder on a variety of different supporting surfaces.

This invention has been described in detail with reference to particular embodiments thereof, but it will be understood that various other modifications can be effected within the spirit and scope of this invention.

What is claimed is:

1. In combination, a multi-use ladder support apparatus and a ladder attached to the support apparatus for mounting to a support structure, said combination comprising:

a frame having a plurality of supports including front and rear supports;

a platform mounted on said frame and extending between said front and rear supports;

a plurality of spaced ladder support brackets mounted to respective front supports of said plurality of supports, each support bracket having a slot, and said platform extending rearwardly in relation to said support brackets;

means for fixedly attaching said frame to the support structure, and a ladder having a rung attached to said ladder support brackets at said slots wherein the ladder extends below and forwardly of said platform.

2. The combination, as claimed in claim 1, wherein:

said platform has front and rear edges;

said rear supports include a pair of spaced vertical supports;

said front supports include a pair of spaced angular supports, wherein said platform is attached to and extends between said vertical supports and said angular supports, one support bracket of said pair of said support brackets each being mounted on a corresponding one of said angular supports.

3. The combination, as claimed in claim 2, wherein:

said pair of vertical supports and said pair of angular supports each have upper ends which extend above said platform.

4. The combination, as claimed in claim 3, wherein:

said upper ends of said vertical supports and said upper ends of said angular supports are joined together.

5. The combination, as claimed in claim 2, further including:

a ladder attachment device which includes a removable rod extending between said ladder brackets and received in said respective slots.

6. The combination, as claimed in claim 5, wherein:

said rod has threaded ends; and a nut is threaded on each rod end.

7. The combination, as claimed in claim 6, wherein:

each of said ladder support bracket slots extend generally parallel to said angular supports and each has an upper end with an opening for inserting and removing said rod.

8. The combination, as claimed in claim 7, further including:

at least one spacer on each end of said rod positioned inwardly of said respective nuts for filling any space between said respective threaded ends of said rod and respective side rails of the ladder.

9. The combination, as claimed in claim 2, wherein:

said pair of vertical supports and said pair of angular supports each have lower ends which extend below said platform; and said attaching means includes a clamping mechanism attached to said respective pairs of lower ends.

10. The combination, as claimed in claim 9, wherein said clamping mechanism includes:

a first adjustable clamping device mounted adjacent said lower ends of said pair of vertical supports for movement inwardly for clamping engagement with the support structure and for movement outwardly for release from the support structure;

a clamp support attached to said lower ends of said pair of angular supports; and a second adjustable clamping device mounted on said clamp support for movement inwardly for clamping engagement with the structure and for movement outwardly for release from the structure.

11. The combination, as claimed in claim 10, wherein said pair of vertical supports are each tubular and said first adjustable clamping device includes:

a pair of extension arms slidably received in said lower ends of said respective vertical supports, each said extension arm having a lower end with a transverse opening therethrough;

a pair of latch devices for holding each said respective extension arm in selected vertical positions within said respective vertical supports; and a first pair of removable clamps extending through said respective transverse openings and mounted for moving inwardly into said clamping engagement and moving outwardly for releasing said clamping engagement.

12. The combination, as claimed in claim 11, wherein:

said clamp support includes a pair of horizontal tubular members extending inwardly from said lower ends of said angular supports; and said second adjustable clamping device includes a pair of clamp extension rods slidably received in said respective horizontal tubular members for movement inwardly for clamping engagement with the structure and for movement outwardly for release from the structure.

13. The combination, as claimed in claim 11, wherein:

said first pair of removable clamps are removed from said respective pairs of extension arms and said extension arms are retracted to that only the lower ends and transverse openings are exposed below said lower ends of said vertical supports;

said clamp support includes a pair of vertical struts each having a plurality of vertically spaced openings extending therethrough;

a pair of support arms each having a first end pivotally attached to said extension arms through said transverse openings and having a second end with a plurality of spaced first openings extending from said second end along said support arms and a plurality of spaced second openings for attaching said support arms to a roof;

a positioning device releasably connected through a selected opening in said pair of vertical struts and a selected first opening in said plurality of spaced first openings to position said support arms at a selected angle with respect to said vertical struts to correspond to the slope of the roof; and attaching elements extendable through said spaced second openings for attaching said support arms to the roof.

14. The combination, as claimed in claim 10, wherein:

said platform has mounting flanges for attachment to the top of the support structure; and said vertical supports have spaced lateral brackets for attachment to said support structure.

15. The combination, as claimed in claim 10, wherein said pair of vertical supports are each tubular and said first adjustable clamping device includes:

a pair of extension arms slidably received in the lower ends of said respective vertical supports, each said extension arm having a lower end with a transverse opening therethrough;

a pair of latch devices for holding each said respective extension arm in selected vertical positions located within said respective vertical supports; and a first pair of removable clamps extending through said respective transverse openings and mounted for moving inwardly toward each other into said clamping engagement with a vertical support therebetween and for moving outwardly for releasing said clamping engagement with said vertical support.

16. In combination, a multi-use ladder support apparatus and a ladder attached to the support apparatus for mounting to a support structure, said combination comprising:

a frame having a plurality of supports including front and rear supports;

a platform mounted on said frame and extending between said front and rear supports;

a plurality of spaced ladder support brackets mounted to respective front supports of said plurality of supports, each support bracket having a slot and said platform extending rearwardly in relation to said support brackets;

clamping means for fixedly attaching said frame to the support structure; and a ladder having a rung attached to said ladder support brackets at said slots wherein the ladder extends below and forwardly at said platform.

17. The combination, as claimed in claim 16, further including:

a ladder attachment device extendable through the upper rung of the ladder and removably connected between said support brackets.

18. The combination, as claimed in claim 17, wherein:

said platform has front and rear edges;

said rear supports include a pair of spaced vertical supports;

said front supports include a pair of spaced angular supports, wherein said platform is attached to and extends between said vertical supports and said angular supports, one support bracket of said pair of said support brackets each being mounted on a corresponding one of said angular supports.

19. The combination, as claimed in claim 18, wherein:

said pair of vertical supports and said pair of angular supports each have upper ends which extend above said platform.

20. The combination, as claimed in claim 19, wherein:

said upper ends of said vertical supports and said upper ends of said angular supports are joined together.

21. The combination, as claimed in claim 17, wherein:

said ladder attachment device includes a removable rod extending between said ladder brackets and received in said respective slots.

22. The combination, as claimed in claim 21, wherein:

said rod has threaded ends; and a nut is threaded on each rod end.

23. The combination, as claimed in claim 22, wherein:

each of said ladder support bracket slots extend generally parallel to said angular supports and each has an upper end with an opening for inserting and removing said rod.

24. The combination, as claimed in claim 23, further including:

at least one spacer on each end of said rod positioned inwardly of said respective nuts for filling any space between said respective threaded ends of said rod and respective side rails of the ladder.

25. The combination, as claimed in claim 17, wherein:

said pair of vertical supports and said pair of angular supports each have lower ends which extend below said platform; and said clamping means includes a clamping mechanism attached to said respective pairs of lower ends.

26. The combination, as claimed in claim 25, wherein said clamping mechanism includes:

a first adjustable clamping device mounted adjacent said lower ends of said pair of vertical supports for movement inwardly for clamping engagement with the support structure and for movement outwardly for release from the support structure;

a clamp support attached to said lower ends of said pair of angular supports; and a second adjustable clamping device mounted on said clamp support for movement inwardly for clamping engagement with the structure and for movement outwardly for release from the structure.

27. The combination, as claimed in claim 26, wherein said pair of vertical supports are each tubular and said first adjustable clamping device includes:

a pair of extension arms slidably received in said lower ends of said respective vertical supports, each said extension arm having a lower end with a transverse opening therethrough;

a pair of latch devices for holding each said respective extension arm in selected vertical positions within said respective vertical supports; and a first pair of removable clamps extending through said respective transverse openings and mounted for moving inwardly into said clamping engagement and moving outwardly for releasing said clamping engagement.

28. The combination, as claimed in claim 27, wherein:

said second clamp support includes a pair of horizontal tubular members extending inwardly from said lower ends of said angular supports; and said second adjustable clamping device includes a pair of clamp extension rods slidably received in said respective horizontal tubular members for movement inwardly for clamping engagement with the structure and for movement outwardly for release from the structure.

29. The combination, as claimed in claim 27, wherein:

said first pair of removable clamps are removed from said respective pairs of extension arms and said extension arms are retracted so that only the lower ends and transverse openings are exposed below said lower ends of said vertical supports;

said clam support includes a pair of vertical struts each having a plurality of vertically spaced openings extending therethrough;

a pair of support arms each having a first end pivotally attached to said extension arms through said transverse openings and having a second end with a plurality of spaced first openings extending from said second end along said support arms and a plurality of spaced second openings for attaching said support arms to a roof;

a positioning device releasably connected through a selected opening in said pair of vertical struts and a selected first opening in said plurality of spaced first openings to position said support arms at a selected angle with respect to said vertical struts to correspond to the slope of the roof; and attaching elements extendable through said spaced second openings for attaching said support arms to the roof.

30. The combination, as claimed in claim 26, wherein:

said platform has mounting flanges for attachment to the top of the support structure; and said vertical supports have spaced lateral brackets for attachment to said support structure.

31. The combination, as claimed in claim 26, wherein said pair of vertical supports are each tubular and said first adjustable clamping device includes:

a pair of extension arms slidably received in the lower ends of said respective vertical supports, each said extension arm having a lower end with a transverse opening therethrough;

a pair of latch devices for holding each said respective extension arm in selected vertical positions located within said respective vertical supports; and a first pair of removable clamps extending through said respective transverse openings and mounted for moving inwardly toward each other into said clamping engagement with a vertical support therebetween and for moving outwardly for releasing said clamping engagement with said vertical support.

32. In combination, a multi-use ladder support apparatus and a ladder attached to the support apparatus for mounting to a support structure, said combination comprising:

a frame having a plurality of supports including front and rear supports;

a platform mounted on said frame and extending between said front and rear supports;

a plurality of spaced ladder support brackets mounted to respective front supports of said plurality of supports, each support bracket having a slot and said platform extending rearwardly in relation to said support brackets;

clamping means for fixedly attaching said frame to a parapet wall; and a ladder baying a rung attached to said ladder support brackets at said slots wherein the ladder extends below and forwardly at said platform.

33. In combination, a multi-use ladder support apparatus and a ladder attached to the support apparatus for mounting to a support structure, said combination comprising:

a frame having a plurality of support including front and rear supports;

a platform mounted on said frame and extending between said front and rear supports;

a plurality of spaced ladder support brackets mounted to respective front supports of said plurality of supports, each support bracket having a slot and said platform extending rearwardly in relation to said support brackets;

a bracket for fixedly attaching said frame to a sloping roof; and a ladder having a ring attached to said ladder support brackets at said slots wherein the ladder extends below and forwardly at said platform.

34. In combination, a multi-use ladder support apparatus and a ladder attached to the support apparatus for mounting to a support structure, said combination comprising:

a frame having a plurality of supports including front and rear supports;

a platform mounted on said frame and extending between said front and rear supports;

a plurality of spaced ladder support brackets mounted to respective front supports of said plurality of supports, each support bracket having a slot and said platform extending rearwardly in relation to said support brackets;

clamping means for fixedly attaching said frame to a vertical structural member; and a ladder having a rung attacked to said ladder support brackets at said slots wherein the ladder extends below and forwardly at said platform.

35. A multi-use ladder support apparatus for mounting on a support structure for a ladder having side rails and hollow tubular rungs, said apparatus comprising:

a frame;

a platform mounted on and supported by said frame said platform having front and rear edges;

a pair of spaced ladder support brackets mounted on said frame, each having a slot for supporting the upper end of a ladder therebetween;

means for fixedly attaching said frame to the support structure;

said frame having a pair of spaced vertical supports and a pair of spaced angular supports, wherein said platform is attached to and extends between said vertical supports and said angular supports, one support bracket of said pair of said support brackets each being mounted on a corresponding one of said angular supports;

said pair of vertical supports and said pair of angular supports each having lower ends which extend below said platform;

said attaching means includes a clamping mechanism attached to said respective pairs of lower ends;

said clamping mechanism comprising a first adjustable clamping device mounted adjacent said lower ends of said pair of vertical supports for movement inwardly for clamping engagement with the support structure and for movement outwardly for release from the support structure, a clamp support attached to said lower ends of said pair of angular supports, and a second adjustable clamping device mounted on said clamp support for movement inwardly for clamping engagement with the structure and for movement outwardly for release from the structure;

said first adjustable clamping device having a pair of extension arms slidably received in said lower ends of said respective vertical supports, each said extension arm having a lower end with a transverse opening therethrough, a pair of latch devices for holding each said respective extension arm in selected vertical positions within said respective vertical supports, and a first pair of removable clamps extending through said respective transverse openings and mounted for moving inwardly into said clamping engagement and moving outwardly for releasing said clamping engagement.

36. A multi-use ladder support apparatus for mounting on a support structure for a ladder having side rails and hollow tubular rungs, said apparatus comprising:

a frame;

a platform mounted on and supported by said frame, said platform having front and rear edges;

a pair of spaced ladder support brackets mounted on said frame, each having a slot for supporting the upper end of a ladder therebetween; and means for fixedly attaching said frame to the support structure;

said frame having a pair of spaced vertical supports, and a pair of spaced angular supports, wherein said platform is attached to and extends between said vertical supports and said angular supports, one support bracket of said pair of said support brackets each being mounted on a corresponding one of said angular supports;

said pair of vertical supports and said pair of angular supports each having lower ends which extend below said platform; and said attaching means includes a clamping mechanism attached to said respective pairs of lower ends;

said clamping mechanism comprising a first adjustable clamping device mounted adjacent said lower ends of said pair of vertical supports for movement inwardly for clamping engagement with the support structure and for movement outwardly for release from the support structure, a clamp support attached to said lower ends of said pair of angular supports, and a second adjustable clamping device mounted on said clamp support for movement inwardly for clamping engagement with the structure and for movement outwardly for release from the structure;

said first adjustable clamping device having a pair of extension arms slidably received in the lower ends of said respective vertical supports, each said extension arm having a lower end with a transverse opening therethrough, a pair of latch devices for holding each said respective extension arm in selected vertical positions located within said respective vertical supports, and a first pair of removable clamps extending through said respective transverse openings and mounted for moving inwardly toward each other into said clamping engagement with a vertical support therebetween and for moving outwardly for releasing said clamping engagement with said vertical support.

37. A multi-use ladder support apparatus for mounting on a support structure for a ladder having side rails and hollow tubular rungs, said apparatus comprising:

a frame;

a platform mounted on and supported by said frame;

a pair of spaced ladder support brackets mounted on said frame for supporting the upper end of a ladder therebetween; and clamping means for fixedly attaching said frame to the support structure;

a ladder attachment device extendable through the upper rung of a ladder and is removablely connected between said support brackets;

said pair of vertical supports and said pair of angular supports each having lower ends which extend below said platform;

said clamping means includes a clamping mechanism attached to said respective pairs of lower ends;

said clamping mechanism having a first adjustable clamping device mounted adjacent said lower ends of said pair of vertical supports for movement inwardly for clamping engagement with the support structure and for movement outwardly for release from the support structure, a clamp support attached to said lower ends of said pair of angular supports;

a second adjustable clamping device mounted on said clamp support for movement inwardly for clamping engagement with the structure and for movement outwardly for release from the structure;

said first adjustable clamping device having a pair of extension arms slidably received in said lower ends of said respective vertical supports, each said extension arm having a lower end with a transverse opening therethrough;

a pair of latch devices for holding each said respective extension arm in selected vertical positions within said respective vertical supports; and a first pair of removable clamps extending through said respective transverse openings and mounted for moving inwardly into said clamping engagement and moving outwardly for releasing said clamping engagement.

38. A multi-use ladder support apparatus for mounting on a support structure for a ladder having side rails and hollow tubular rungs, said apparatus comprising:

a frame;

a platform mounted on and supported by said frame;

a pair of spaced ladder support brackets mounted on said frame for supporting the upper end of a ladder therebetween;

clamping means for fixedly attaching said frame to the support structure;

a ladder attachment device extendable through the upper rung of a ladder and is removablely connected between said support brackets;

said pair of vertical supports and said pair of angular supports each have lower ends which extend below said platform;

said clamping means includes a clamping mechanism attached to said respective pairs of lower ends;

said clamping mechanism having a first adjustable clamping device mounted adjacent said lower ends of said pair of vertical supports for movement inwardly for clamping engagement with the support structure and for movement outwardly for release from the support structure, a clamp support attached to said lower ends of said pair of angular supports, a second adjustable clamping device mounted on said clamp support for movement inwardly for clamping engagement with the structure and for movement outwardly for release from the structure;

said first adjustable clamping device having a pair of extension arms slidably received in the lower ends of said respective vertical supports, each said extension arm having a lower end with a transverse opening therethrough, a pair of latch devices for holding each said respective extension arm in selected vertical positions located within said respective vertical supports, and a first pair of removable clamps extending through said respective transverse openings and mounted for moving inwardly toward each other into said clamping engagement with a vertical support therebetween and for moving outwardly for releasing said clamping engagement with said vertical support.

* * * * *

UNITED STATES PATENT AND TRADEMARK OFFICE

CERTIFICATE OF CORRECTION

PATENT NO. : 6,533,069 B1
DATED : March 18, 2003
INVENTOR(S) : Richard Couillard It is certified that error appears in the above-identified patent and that said Letters Patent is hereby corrected as shown below:

Column 10,
Line 44, delete “baying” and insert -- having -- therein.

Signed and Sealed this

Sixth Day of May, 2003

JAMES E. ROGAN
*Director of the United States Patent and Trademark Office*